US010265754B2

(12) United States Patent
Kobayashi et al.

(10) Patent No.: US 10,265,754 B2
(45) Date of Patent: Apr. 23, 2019

(54) FIXING SLEEVE AND MANUFACTURING METHOD THEREOF

(71) Applicant: K.K. ENDO SEISAKUSHO, Niigata-ken (JP)

(72) Inventors: Tsuyoshi Kobayashi, Niigata (JP); Tsuyoshi Saito, Niigata (JP); Takashi Yaoita, Niigata (JP); Katsutoshi Maruyama, Niigata (JP)

(73) Assignee: K.K. ENDO SEISAKUSHO, Niigata-ken (JP)

( * ) Notice: Subject to any disclaimer, the term of this patent is extended or adjusted under 35 U.S.C. 154(b) by 134 days.

(21) Appl. No.: 15/045,186

(22) Filed: Feb. 16, 2016

(65) Prior Publication Data

US 2016/0236258 A1 Aug. 18, 2016

(30) Foreign Application Priority Data

Feb. 17, 2015 (JP) ..... 2015-028515

(51) Int. Cl.
*B21D 22/16* (2006.01)
*B24B 39/04* (2006.01)
(Continued)

(52) U.S. Cl.
CPC ..... *B21D 22/16* (2013.01); *B21D 33/00* (2013.01); *B24B 39/04* (2013.01); *B24C 1/08* (2013.01);
(Continued)

(58) Field of Classification Search
CPC ..... B21D 22/14; B21D 22/16; B21D 22/18; B24B 39/04; B24C 1/08; B24C 3/325
See application file for complete search history.

(56) References Cited

U.S. PATENT DOCUMENTS 3,685,475 A * 8/1972 Banks, Jr. ..... B21D 22/16 72/69
4,118,846 A * 10/1978 Korte ..... B24B 39/04 72/81
(Continued)

FOREIGN PATENT DOCUMENTS

CN 101046654 10/2007
CN 100386697 5/2008
(Continued)

OTHER PUBLICATIONS

JPO Machine translation of JP 60263671 A.*
(Continued)

*Primary Examiner* — Pradeep C Battula
(74) *Attorney, Agent, or Firm* — JCIPRNET

(57) ABSTRACT

Provided is a fixing sleeve making it possible to reduce the surface roughness of the inner circumferential surface of the fixing sleeve by spinning, and a method for manufacturing the fixing sleeve. The spinning is performed by moving rollers, in the axial direction of a cup-shaped tubular body and, at the same time, a burnishing tool (spherical tool) is pressed against the outer circumferential surface of the cup-shaped tubular body after the spinning, and the burnishing tool is moved in the same direction as the rollers. The cup-shaped tubular body is plastically deformed in the axial direction of the cup-shaped tubular body, reduced in wall thickness, and elongated in the axial direction.

2 Claims, 20 Drawing Sheets

(51) Int. Cl.

| | |
|---|---|
| ***B24C 1/08*** | (2006.01) |
| ***B24C 3/32*** | (2006.01) |
| ***B21D 33/00*** | (2006.01) |
| ***G03G 15/20*** | (2006.01) |

(52) U.S. Cl.
CPC ..... *B24C 3/325* (2013.01); *G03G 15/2053* (2013.01); *G03G 15/2057* (2013.01)

(56) References Cited

U.S. PATENT DOCUMENTS

| | | | | |
|---|---|---|---|---|
| 5,428,980 | A * | 7/1995 | Iidaka | B21D 22/16 72/83 |
| 6,247,997 | B1 * | 6/2001 | Khalaj | B24C 7/0046 451/2 |
| 6,561,001 | B2 * | 5/2003 | Sakuma | B21D 22/14 72/370.14 |
| 7,229,398 | B2 * | 6/2007 | Sakuma | B21D 26/14 492/54 |
| 7,601,232 | B2 * | 10/2009 | Fonte | B21D 22/16 72/343 |
| 7,650,104 | B2 * | 1/2010 | Baba | G03G 15/0812 399/274 |
| 7,762,114 | B2 * | 7/2010 | Abney | B21D 22/16 72/370.01 |
| 7,963,016 | B2 * | 6/2011 | Ito | B21D 22/16 29/407.01 |
| 8,351,835 | B2 * | 1/2013 | Maruyama | B21D 22/16 72/85 |
| 2003/0035667 | A1 * | 2/2003 | Izawa | G03G 15/2053 399/333 |
| 2010/0163544 | A1 * | 7/2010 | Shirai | G03G 15/2053 72/378 |
| 2015/0184698 | A1 * | 7/2015 | Govert | B21D 22/16 29/898.07 |

FOREIGN PATENT DOCUMENTS

| | | | |
|---|---|---|---|
| CN | 102489627 | | 6/2012 |
| CN | 103228374 | | 7/2013 |
| DE | 2941160 | | 4/1981 |
| EP | 1424147 | | 6/2004 |
| JP | 60263671 | A * | 12/1985 |
| JP | 2000061570 | | 2/2000 |
| JP | 4133263 | | 8/2008 |
| JP | 2010029893 | | 2/2010 |
| WO | 2010073476 | | 7/2010 |

OTHER PUBLICATIONS

Runge, Manfred: Drücken und Drückwalzen: Umformtechnik, Werkstück-gestaltung, Maschinen, Steuerungskonzepte, Verl. Moderne Industrie, 1993, Seiten 51 bis 61, pp. 1-7.

Fritz Klocke, Wilfried König, Fertigungsverfahren 4, Umformen, Springer Verlag, 5 Auflage, 2006, Seite 393, pp. 1.

"The Third Party Observation of European Counterpart Application," issued on Jul. 28, 2017, pp. 1-4.

"Search Report of European Counterpart Application", dated Jun. 15, 2016, p. 1-p. 7.

"Office Action of China Counterpart Application," dated Oct. 24, 2017, p. 1-p. 6.

"Office Action of China Counterpart Application," dated Jul. 13, 2018, p. 1-p. 7.

"Office Action of China Counterpart Application," dated Nov. 5, 2018, pp. 1-5.

* cited by examiner

| ABRASIVE CONDITIONS | | MEASUREMENT LOCATION | Rv END(b) | Rv END(a) | Rpk END(b) | Rpk END(a) | Ra END(b) | Ra END(a) | Rz END(b) | Rz END(a) |
|---|---|---|---|---|---|---|---|---|---|---|
| 1 | 45kPa 25s ZIRCON#320 | NO.1 | 0.730 | 0.710 | 0.241 | 0.141 | 0.177 | 0.112 | 1.163 | 0.788 |
| | | NO.2 | 0.761 | 0.471 | 0.242 | 0.147 | 0.180 | 0.114 | 1.186 | 0.770 |
| | | NO.3 | 0.796 | 0.547 | 0.253 | 0.165 | 0.170 | 0.106 | 1.150 | 0.784 |
| | | NO.4 | 0.820 | 0.530 | 0.253 | 0.184 | 0.184 | 0.530 | 1.252 | 0.839 |
| | | AVERAGE VALUE | 0.777 | 0.565 | 0.247 | 0.159 | 0.178 | 0.216 | 1.188 | 0.795 |
| 2 | 45kPa 50s ZIRCON#320 | NO.1 | 0.839 | 0.551 | 0.269 | 0.172 | 0.190 | 0.137 | 1.230 | 0.900 |
| | | NO.2 | 0.725 | 0.595 | 0.260 | 0.159 | 0.205 | 0.130 | 1.280 | 0.856 |
| | | NO.3 | 0.651 | 0.709 | 0.223 | 0.189 | 0.194 | 0.134 | 1.150 | 0.967 |
| | | NO.4 | 0.650 | 0.739 | 0.260 | 0.176 | 0.195 | 0.136 | 1.186 | 0.912 |
| | | AVERAGE VALUE | 0.716 | 0.649 | 0.253 | 0.174 | 0.196 | 0.134 | 1.212 | 0.909 |
| 3 | 50kPa 25s ZIRCON#320 | NO.1 | 0.660 | 0. 637 | 0.290 | 0.159 | 0.177 | 0.121 | 1.195 | 0.841 |
| | | NO.2 | 0.698 | 0.566 | 0.199 | 0.143 | 0.176 | 0.119 | 1.096 | 0.794 |
| | | NO.3 | 0.745 | 0.545 | 0.265 | 0.171 | 0.184 | 0.132 | 1.210 | 0.849 |
| | | NO.4 | 0.614 | 0.540 | 0.232 | 0.148 | 0.176 | 0.131 | 1.078 | 0.844 |
| | | AVERAGE VALUE | 0.679 | 0.623 | 0.247 | 0.155 | 0.178 | 0.126 | 1.145 | 0.832 |
| 4 | 50kPa 50s ZIRCON#320 | NO.1 | 0.870 | 0.680 | 0.250 | 0.214 | 0.216 | 0.148 | 1.310 | 0.993 |
| | | NO.2 | 1.270 | 0.591 | 0.254 | 0.180 | 0.196 | 0.142 | 1.270 | 0.913 |
| | | NO.3 | 0.922 | 0.589 | 0.306 | 0.181 | 0.212 | 0.149 | 1.415 | 0.984 |
| | | NO.4 | 0.857 | 0.594 | 0.303 | 0.183 | 0.224 | 0.131 | 1.391 | 0.878 |
| | | AVERAGE VALUE | 0.980 | 0.614 | 0.278 | 0.190 | 0.212 | 0.143 | 1.347 | 0.942 |
| 5 | 45kPa 25s SUS#300 | NO.1 | 0.472 | 0.571 | 0.128 | 0.137 | 0.100 | 0.116 | 0.685 | 0.753 |
| | | NO.2 | 0.688 | 0.579 | 0.135 | 0.106 | 0.104 | 0.110 | 0.763 | 0.744 |
| | | NO.3 | 0.941 | 0.786 | 0.145 | 0.109 | 0.117 | 0.123 | 0.919 | 0.753 |
| | | NO.4 | 0.711 | 0.466 | 0.150 | 0.109 | 0.105 | 0.102 | 0.806 | 0.670 |
| | | AVERAGE VALUE | 0.703 | 0.601 | 0.140 | 0.115 | 0.107 | 0.113 | 0.793 | 0.730 |
| 6 | 45kPa 50s SUS#300 | NO.1 | 0.788 | 0.587 | 0.122 | 0.124 | 0.113 | 0.107 | 0.839 | 0.732 |
| | | NO.2 | 0.815 | 0.717 | 0.152 | 0.117 | 0.120 | 0.132 | 0.912 | 0.852 |
| | | NO.3 | 0.594 | 0.768 | 0.150 | 0.127 | 0.115 | 0.124 | 0.825 | 0.907 |
| | | NO.4 | 0.703 | 0.758 | 0.133 | 0.138 | 0.117 | 0.124 | 0.850 | 0.768 |
| | | AVERAGE VALUE | 0.725 | 0.708 | 0.139 | 0.127 | 0.116 | 0.122 | 0.857 | 0.815 |
| 7 | 50kPa 25s SUS#300 | NO.1 | 0.611 | 0.574 | 0.168 | 0.114 | 0.112 | 0.107 | 0.819 | 0.701 |
| | | NO.2 | 0.776 | 0.523 | 0.153 | 0.096 | 0.121 | 0.105 | 0.872 | 0.689 |
| | | NO.3 | 0.416 | 0.533 | 0.144 | 0.145 | 0.098 | 0.109 | 0.682 | 0.715 |
| | | NO.4 | 0.649 | 0.531 | 0.138 | 0.123 | 0.109 | 0.111 | 0.773 | 0.716 |
| | | AVERAGE VALUE | 0.613 | 0.540 | 0.151 | 0.120 | 0.110 | 0.108 | 0.787 | 0.705 |
| 8 | 50kPa 50s SUS#300 | NO.1 | 0.696 | 0.534 | 0.108 | 0.099 | 0.118 | 0.107 | 0.812 | 0.676 |
| | | NO.2 | 0.810 | 0.696 | 0.135 | 0.117 | 0.136 | 0.115 | 0.890 | 0.753 |
| | | NO.3 | 0.564 | 0.584 | 0.127 | 0.113 | 0.118 | 0.119 | 0.778 | 0.718 |
| | | NO.4 | 0.895 | 0.965 | 0.170 | 0.115 | 0.116 | 0.121 | 1.055 | 0.874 |
| | | AVERAGE VALUE | 0.741 | 0.695 | 0.135 | 0.111 | 0.122 | 0.116 | 0.884 | 0.755 |

FIG.14

TABLE IN WHICH ABRASIVE CONDITIONS 1 TO 8 ARE ARRANGED IN THE ORDER OF INCREASING VALUE OF Rv

| MEASUREMENT LOCATION | VALUE OF Rv AT END (b) | VALUE OF Rv AT END (a) |
|---|---|---|
| NO.1 | 4>2>6>1>8>3>7>5 | 1>4>3>6>7>5>2>8 |
| NO.2 | 4>6>8>7>1>2>3>5 | 6>8>2>4>5>3>7>1 |
| NO.3 | 5>4>1>3>2>6>8>7 | 5>6>2>4>8>1>3>7 |
| NO.4 | 8>4>1>5>6>2>7>3 | 8>6>2>4>3>7>1>5 |
| AVERAGE VALUE | 4>1>8>6>2>5>3>7 | 6>8>2>3>4>5>1>7 |

FIG.20A

TABLE IN WHICH ABRASIVE CONDITIONS 1 TO 8 ARE ARRANGED IN THE ORDER OF DECREASING VALUE OF Rpk

| MEASUREMENT LOCATION | VALUE OF Rpk AT END (b) | VALUE OF Rpk AT END (a) |
|---|---|---|
| NO.1 | 8<6<5<7<1<4<2<3 | 8<7<6<5<1<3<2<4 |
| NO.2 | 8<5<6<7<3<1<4<2 | 7<5<8<6<3<1<2<4 |
| NO.3 | 8<7<5<6<2<1<3<4 | 5<8<6<7<1<3<4<2 |
| NO.4 | 6<7<5<8<3<1<2<4 | 5<8<7<6<3<2<4<1 |
| AVERAGE VALUE | 8<6<5<7<3<1<2<4 | 8<5<7<6<3<1<2<4 |

FIG.20B

FIXING SLEEVE AND MANUFACTURING METHOD THEREOF

FIELD OF THE INVENTION

The present invention relates to a thin-wall metal tubular body and a manufacturing method thereof, and more particularly to a fixing sleeve for fixing a toner to paper by applying heat and pressure in a laser printer or copier, and also to a method for manufacturing the fixing sleeve.

DESCRIPTION OF THE RELATED ART

The fixing system of laser printers and copiers has been changed from the conventional roller fixing system to a film fixing system. With the conventional roller fixing system, a heater located inside the roller needs to be actuated even in the printing standby mode in order to warm up the roller. By contrast, with the thin fixing sleeve having a high thermal conduction efficiency and a low thermal capacity, the heater is actuated only when the fixing sleeve rotates. Therefore, power can be saved and the standby time can be shortened. A metal such as stainless steel or a resin such as a polyimide is used as the thin-wall tubular body serving as a base layer of the fixing sleeve. However, from the standpoint of saving power and shortening the standby time, it is preferred that a metal of a high strength and excellent thermal conductivity be used.

During the fixing, it is necessary that a cylindrical fixing sleeve rotate while deforming in the circumferential direction, a heating heater constituting a fixing nip portion come into contact with the inner circumferential surface of the fixing sleeve, and the heat of the heating heater be transferred to the fixing nip portion. Therefore, thermal efficiency is strongly affected by the surface roughness of the inner circumferential surface of the fixing sleeve, and where the thermal efficiency is degraded, fixing defects occur. A method has been suggested for forming a film with a low friction resistance, for example from a fluororesin, on the inner circumferential surface of a fixing sleeve, but such a method raises the production cost and degrades the thermal efficiency due to the increase in the film thickness.

A fixing sleeve needs circumferential flexibility and durability to withstand deformation. Where a metal tubular body is used as the base layer of the fixing sleeve, it is manufactured to have a very small thickness of 20 μm to 50 μm. A spinning process is well known as a method for manufacturing such ultrathin metal tubular bodies (see Patent Literature 1).

However, with the spinning process disclosed in Patent Literature 1, since a mandrel is fitted on the inner circumferential surface of a cylindrical metal tubular body and a roller is pressed against the outer circumferential surface of the metal tubular body, fine protrusions and depressions present on the outer circumferential surface of the mandrel are transferred to the inner circumferential surface of the metal tubular body and the resultant surface seems matted to the naked eye. Further, roller marks forming during the spinning process remain on the inner circumferential surface of the cylindrical metal tubular body, and unevenness with a pitch of 0.1 mm to 0.5 mm and an amplitude of 0.2 μm to 3.0 μm remains thereon.

[Patent Literature 1] Japanese Patent No. 4133263

SUMMARY

It is an objective of the present invention to provide a fixing sleeve that makes it possible to process the inner circumferential surface of a cup-shaped tubular body or fixing sleeve during a spinning process into a smooth surface, thereby processing the fixing sleeve having an optimum outer surface, and also to a method for manufacturing such a fixing sleeve.

Another objective of the present invention is to provide a fixing sleeve that makes it possible to reduce the surface roughness of the inner circumferential surface of the fixing sleeve by a spinning process, and also to a method for manufacturing such a fixing sleeve.

The abovementioned problems are resolved with the following means.

Thus, a method for manufacturing a fixing sleeve according to the first aspect of the invention includes: performing a spinning process by fitting a mandrel on an inner circumferential surface of a cup-shaped tubular body which is made of metal and pressing a roller against an outer circumferential surface of the cup-shaped tubular body, thereby elongating the cup-shaped tubular body in an axial direction and reducing a wall thickness of the cup-shaped tubular body, and processing the inner circumferential surface of the cup-shaped tubular body or the inner circumferential surface of the fixing sleeve into a smooth surface.

A method for manufacturing a fixing sleeve according to the second aspect of the invention is the method according to the first aspect, wherein the smooth surface is obtained by making the outer circumferential surface of the mandrel during the spinning process become a smooth surface with a small surface roughness and transferring the smooth surface of the outer circumferential surface of the mandrel onto the inner circumferential surface of the cup-shaped tubular body, thereby mirror finishing the inner circumferential surface of the fixing sleeve which has been reduced in the wall thickness.

A method for manufacturing a fixing sleeve according to the third aspect of the invention is the method according to the first aspect, wherein a roller mark formed during the spinning process is removed by pressing a burnishing tool against the outer circumferential surface of the cup-shaped tubular body after the spinning process.

A method for manufacturing a fixing sleeve according to the fourth aspect of the invention is the method according to the second aspect, wherein a roller mark formed during the spinning process is removed by pressing a burnishing tool against the outer circumferential surface of the cup-shaped tubular body after the spinning process.

A method for manufacturing a fixing sleeve according to the fifth aspect of the invention is the method according to the first aspect, wherein the cup-shaped tubular body is provided with a satin finished surface by polishing the inner circumferential surface of the cup-shaped tubular body produced by drawing a metal plate, in order to obtain the smooth surface, and the spinning process is performed by fitting the mandrel on the inner circumferential surface of the metal cup-shaped tubular body and pressing the roller against the outer circumferential surface of the cup-shaped tubular body, thereby elongating the cup-shaped tubular body in the axial direction and reducing the wall thickness of the cup-shaped tubular body.

A method for manufacturing a fixing sleeve according to the sixth aspect of the invention is the method according to the fifth aspect, wherein a roller mark formed during the spinning process is removed by pressing a burnishing tool against the outer circumferential surface of the cup-shaped tubular body after the spinning process.

A method for manufacturing a fixing sleeve according to the seventh aspect of the invention is the method according to the first aspect, wherein the fixing sleeve is molded in a tubular shape by cutting out both ends of the cup-shaped tubular body after the spinning process, and an abrasive material is sucked in under a negative pressure and jetted onto the inner circumferential surface of the fixing sleeve and the inner circumferential surface is polished to obtain the smooth surface.

A method for manufacturing a fixing sleeve according to the eighth aspect of the invention is the method according to the seventh aspect, wherein a surface roughness of the inner circumferential surface of the fixing sleeve is evaluated by two numerical values, namely, a maximum valley depth (Rv) and an initial wear height (Rpk).

A fixing sleeve according to the first aspect of the invention is obtained by a method for manufacturing a fixing sleeve in which a spinning process is performed by fitting a mandrel on an inner circumferential surface of a cup-shaped tubular body which is made of metal and pressing a roller against an outer circumferential surface of the cup-shaped tubular body, thereby the cup-shaped tubular body is elongated in an axial direction and a wall thickness of the cup-shaped tubular body is reduced, wherein the inner circumferential surface of the cup-shaped tubular body or the inner circumferential surface of the fixing sleeve is processed into a smooth surface.

With the fixing sleeve and the manufacturing method thereof in accordance with the present invention, the inner circumferential surface of the cup-shaped tubular body or fixing sleeve is processed into a smooth surface during the spinning process. Therefore, a fixing sleeve having an optimum outer surface can be produced.

BRIEF DESCRIPTION OF THE DRAWINGS

FIG. 14 is a table obtained by measuring the surface roughness of the inner circumferential surface of the fixing sleeve subjected to the inner surface polishing according to the fourth embodiment of the present invention; the results in the table were measured after polishing under the Abrasive Condition 1 to Abrasive Condition 8;

FIG. 14, and FIG. 19 (*p*) to FIG. 19 (*w*) eight microphotographs (the original color is yellow) illustrate the height (depth) of protrusions and depressions of a contour curve; light gray portions represent low portions and dark gray portions represent high portions; and FIG. 20A is a table in which the Abrasive Conditions 1 to 8 shown in the table in FIG. 14 are arranged in the order of increasing value of the maximum valley depth (Rv), and FIG. 20B is a table in which the Abrasive Conditions 1 to 8 shown in the table in FIG. 14 are arranged in the order of decreasing value of the initial wear height (Rpk).

DESCRIPTION OF THE PREFERRED EMBODIMENTS

[First Embodiment of the Method for Manufacturing a Fixing Sleeve]

Figure 1B:
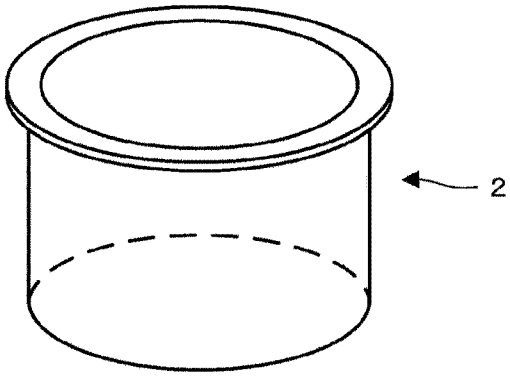
FIGS. 1A and 1B illustrate the method for manufacturing a fixing sleeve according to the first embodiment of the present invention, FIG. 1A being a vertical sectional view illustrating a step of molding a cup-shaped tubular body by deep drawing, and FIG. 1B being a perspective view illustrating the molded cup-shaped tubular body.
Figure 1A:
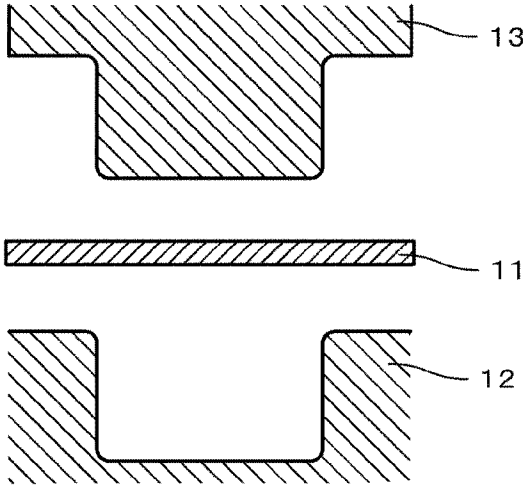

The first embodiment of the present invention will be explained hereinbelow with reference to the drawings. FIGS. 1A and 1B illustrate the method for manufacturing a fixing sleeve according to the first embodiment of the present invention. FIG. 1A is a vertical sectional view illustrating a step of molding a cup-shaped tubular body by deep drawing; FIG. 1B is a perspective view illustrating the molded cup-shaped tubular body. As depicted in FIG. 1A, a thin metal sheet 11, e.g. of SUS304, is deep drawn with a female mold 12 and a punch 13 to mold the cup-shaped tubular body 2 depicted in FIG. 1B.

Figure 2A:
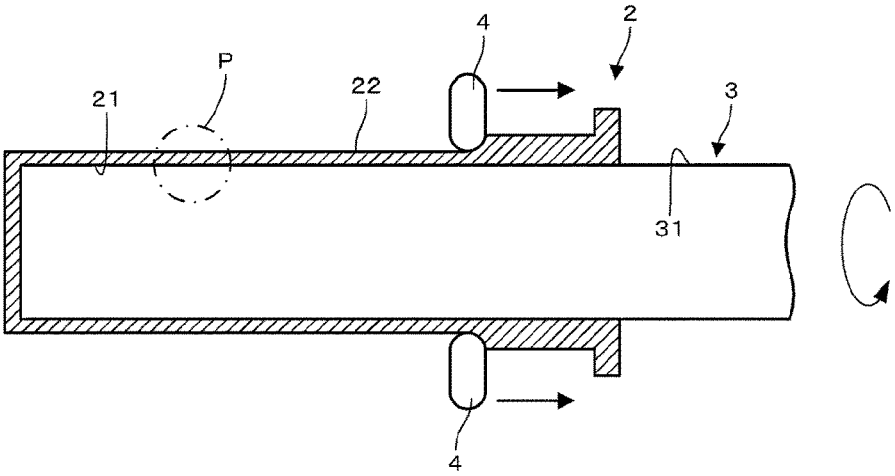
FIGS. 2A and 2B illustrate steps performed after the step illustrated by FIGS. 1A and 1B, FIG. 2A being an explanatory drawing illustrating a step of performing a spinning process to the cup-shaped tubular body depicted in FIG. 1B by using a mandrel according to the first embodiment of the present invention, and FIG. 2B being an explanatory drawing illustrating a step of molding a tubular fixing sleeve by cutting out both ends of the cup-shaped tubular body after the spinning process.
Figure 2B:
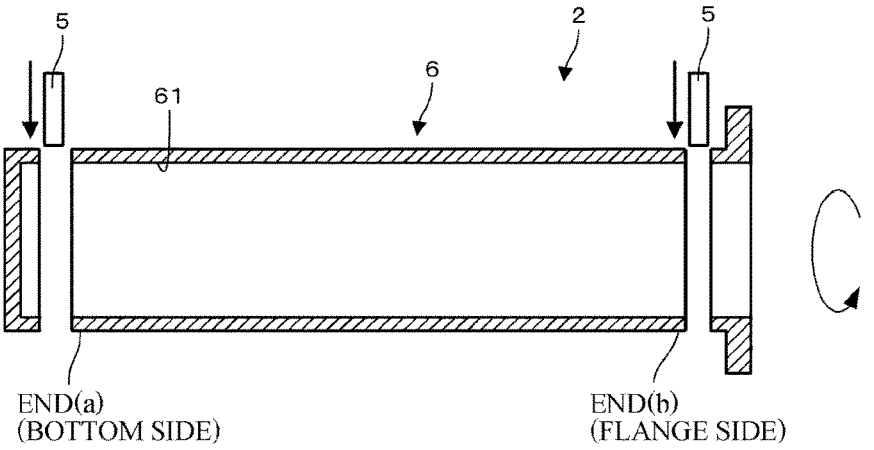

FIGS. 2A and 2B illustrate steps performed after the step illustrated by FIGS. 1A and 1B. FIG. 2A is an explanatory drawing illustrating a step of performing a spinning process to the cup-shaped tubular body 2 depicted in FIG. 1B by using a mandrel according to the first embodiment of the present invention. FIG. 2B is an explanatory drawing illustrating a step of molding a tubular fixing sleeve by cutting out both ends of the cup-shaped tubular body after the spinning process. Thus, as depicted in FIG. 2A, a mandrel 3 of a spinning machine is fitted on an inner circumferential surface 21 of the cup-shaped tubular body 2, and the mandrel 3 is rotated to rotate the cup-shaped tubular body 2. The spinning process is performed by pressing rollers 4 against an outer circumferential surface 22 of the cup-shaped tubular body 2 and moving the rollers 4, in the axial direction of the cup-shaped tubular body 2. The cup-shaped tubular body 2 is plastically deformed in the axial direction of the cup-shaped tubular body 2, reduced in wall thickness, and elongated in the axial direction. As depicted in FIG. 2B, where both ends of the cup-shaped tubular body 2 subjected to the spinning process are cut with parting bytes 5, a tubular fixing sleeve 6 is obtained.

Figure 3B:
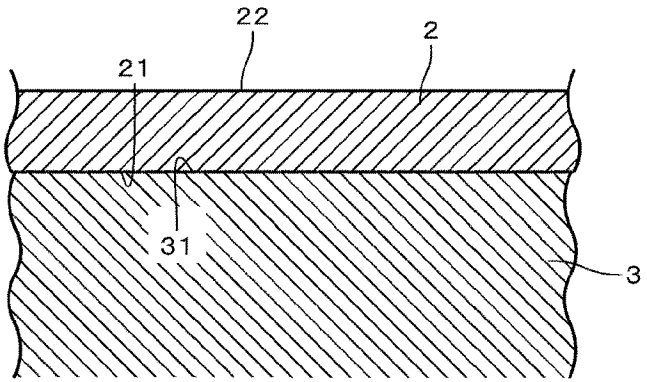
FIGS. 3A and 3B show the enlarged cross-sectional view of the P portion in FIG. 2A, FIG. 3A showing the enlarged cross-sectional view of the P portion illustrating the spinning process performed with the conventional mandrel, and FIG. 3B showing the enlarged cross-sectional view of the P portion illustrating the spinning process performed with the mandrel of the first embodiment of the present invention.
Figure 3A:
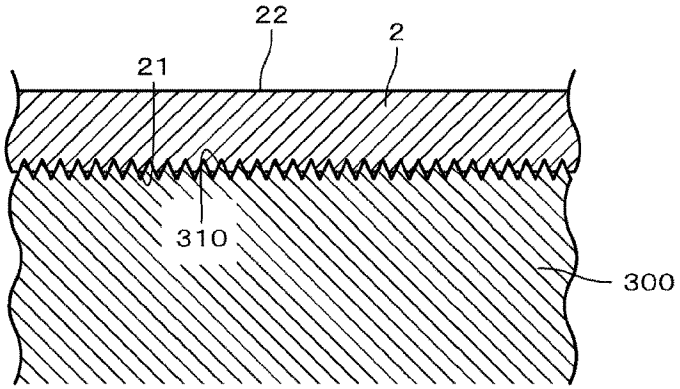

FIGS. 3A and 3B show the enlarged cross-sectional view of the P portion in FIG. 2A; FIG. 3A shows the enlarged cross-sectional view of the P portion illustrating the spinning process performed with a conventional mandrel 300. FIG. 3B shows the enlarged cross-sectional view of the P portion illustrating the spinning process performed with the mandrel 3 of the first embodiment of the present invention. In order to prevent burn-in during the spinning process, a high-viscosity lubricating oil with a viscosity of 1900 $mm^2/s$ (40° C.) has been conventionally used. Therefore, as depicted in FIG. 3A, fine protrusions and depressions for retaining the lubricating oil have been formed on an outer circumferential surface 310 of the conventional mandrel 300. For this reason, fine protrusions and depressions of the outer circumferential surface 310 of the mandrel 300 have been transferred to the inner circumferential surface 21 of the cup-shaped tubular body 2, and the inner circumferential surface 21 of the cup-shaped tubular body 2 seems matted to the naked eye.

Figure 4A:
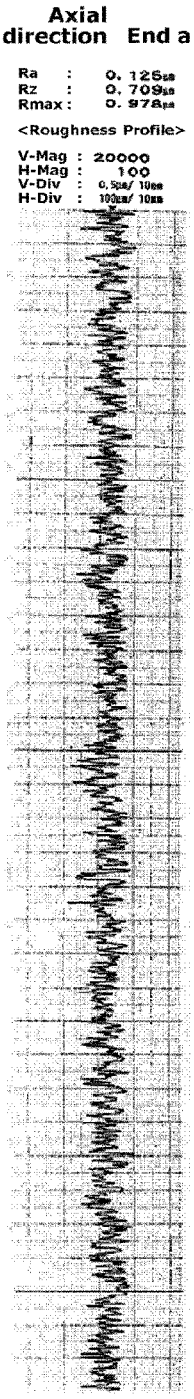
FIGS. 4A-4D show data obtained by measuring the surface roughness of the inner circumferential surface of the fixing sleeve processed by the spinning process with the conventional mandrel.
Figure 4B:
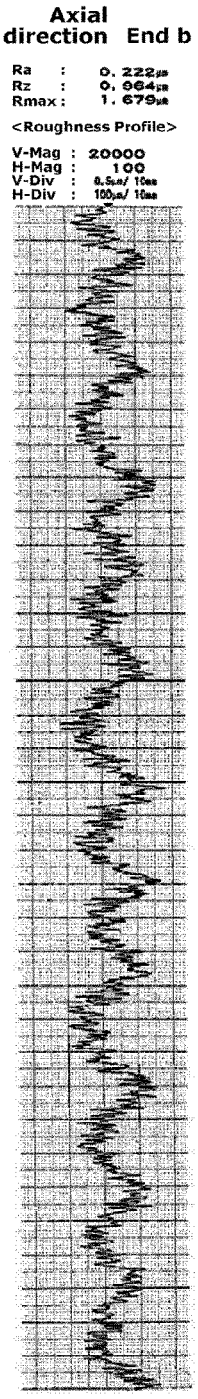
Figure 4C:
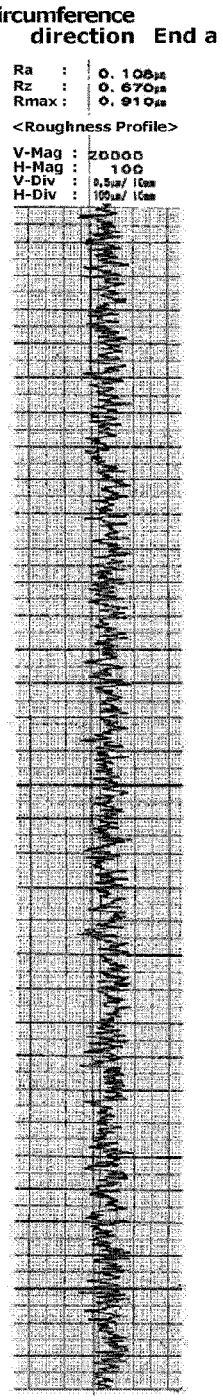
Figure 4D:
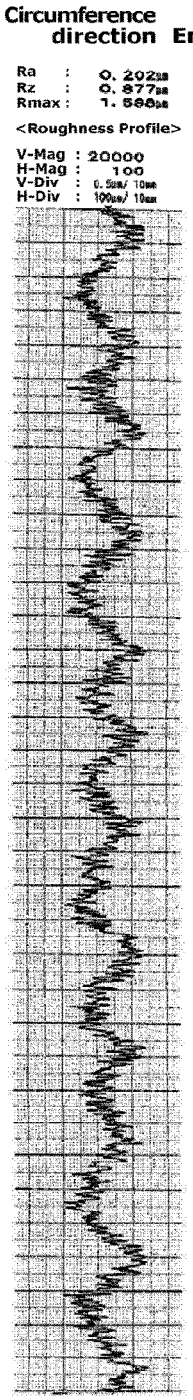

FIGS. 4A-4D show data obtained by measuring the surface roughness of an inner circumferential surface 61 of the fixing sleeve 6 processed by spinning process with the conventional mandrel 300. Thus, FIG. 4A shows data obtained by measuring the axial surface roughness of the end (a) (left end of the fixing sleeve 6; referred to as a bottom side) in FIG. 2B. FIG. 4B shows data obtained by measuring the axial surface roughness of the end (b) (right end of the fixing sleeve 6; referred to as a flange side) in FIG. 2B. FIG. 4C shows data obtained by measuring the circumferential surface roughness of the end (a) in FIG. 2B. FIG. 4D shows data obtained by measuring the circumferential surface roughness of the end (b) in FIG. 2B. As depicted in FIGS. 4A-4D, on the inner circumferential surface 61 of the fixing sleeve 6 processed by spinning process with the conventional mandrel 300, the center line average roughness (Ra) is 0.108 μm to 0.222 μm, the ten-point average height (Rz) is 0.670 μm to 0.964 μm, the maximum height (Rmax) is 0.910 μm to 1.679 μm, and a large number of fine protrusions and depressions have been formed.

As depicted in FIG. 3B, as a result of using a lubricating oil with a viscosity of 4.1 $mm^2/s$ (40° C.) which is lower than that in the prior art, the outer circumferential surface 31 of the mandrel 3 of the first embodiment of the present invention is a smooth surface with a small surface roughness. Therefore, the smooth surface of the outer circumferential surface 31 of the mandrel 3 is transferred to the inner circumferential surface 21 of the cup-shaped tubular body 2, fine depressions and protrusions are eliminated from the inner circumferential surface 21 of the cup-shaped tubular body 2, and the inner circumferential surface 21 of the cup-shaped tubular body 2 becomes mirror finished to the naked eye.

Figure 5A:
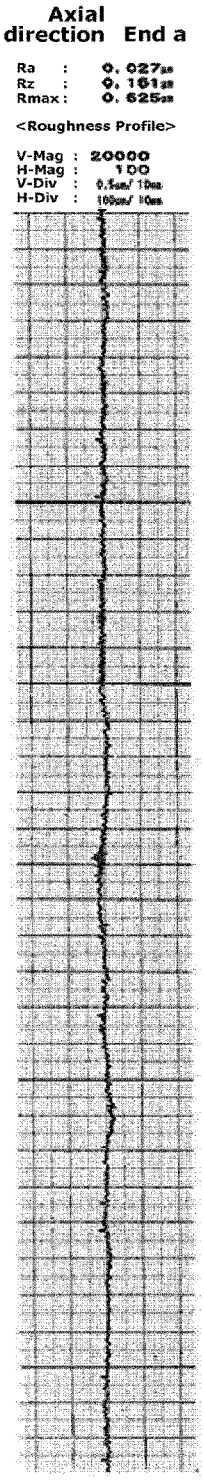
FIGS. 5A-5D show data obtained by measuring the surface roughness of the inner circumferential surface of the fixing sleeve processed by the spinning process with the mandrel of the first embodiment of the present invention.
Figure 5B:
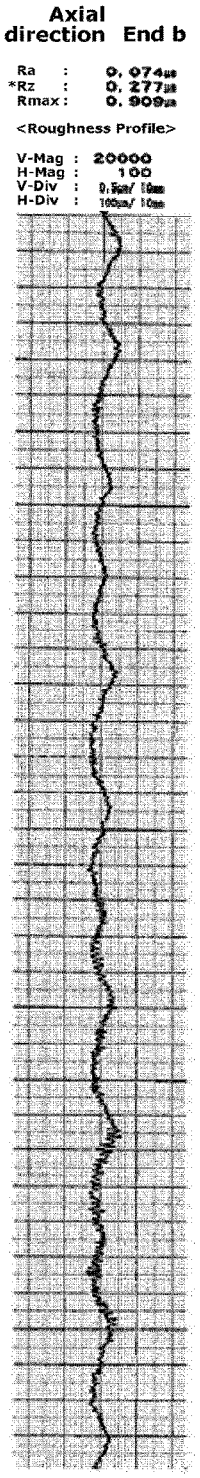
Figure 5C:
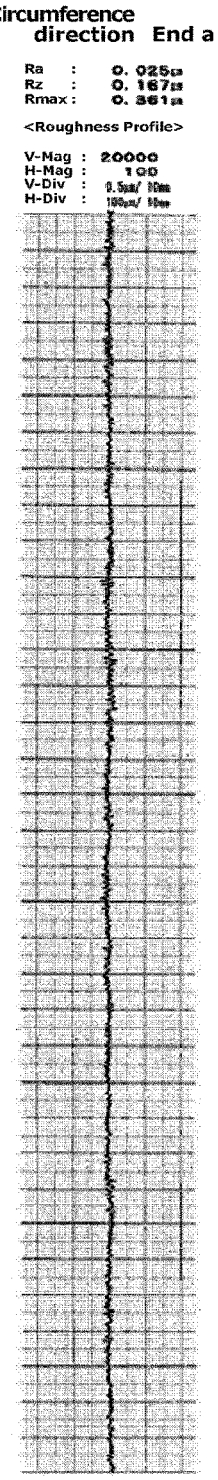
Figure 5D:
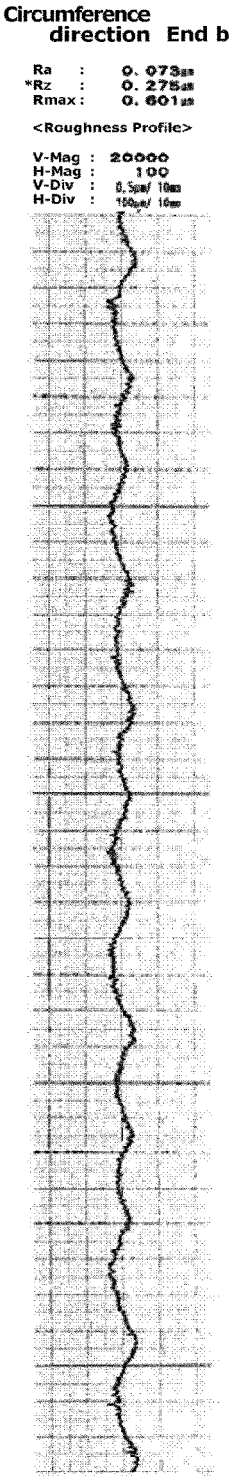

FIGS. 5A-5D show data obtained by measuring the surface roughness of the inner circumferential surface 61 of the fixing sleeve 6 processed by spinning process with the mandrel 3 of the first embodiment of the present invention. Thus, FIG. 5A shows data obtained by measuring the axial surface roughness of the end (a) in FIG. 2B. FIG. 5B shows data obtained by measuring the axial surface roughness of the end (b) in FIG. 2B. FIG. 5C shows data obtained by measuring the circumferential surface roughness of the end (a) in FIG. 2B. FIG. 5D shows data obtained by measuring the circumferential surface roughness of the end (b) in FIG. 2B. As depicted in FIGS. 5A-5D, on the inner circumferential surface 61 of the fixing sleeve 6 processed by the spinning process with the mandrel 3 according to the first embodiment, the center line average roughness (Ra) is 0.025 μm to 0.074 μm, the ten-point average height (Rz) is 0.151 μm to 0.277 μm, and the maximum height (Rmax) is 0.361 μm to 0.909 μm. Thus the center line average roughness (Ra) and ten-point average height (Rz) are about four times less and the maximum height (Rmax) is about two times less than those of the prior art, and fine protrusions and depressions are eliminated.

[Second Embodiment of the Method for Manufacturing a Fixing Sleeve]

Figure 6A:
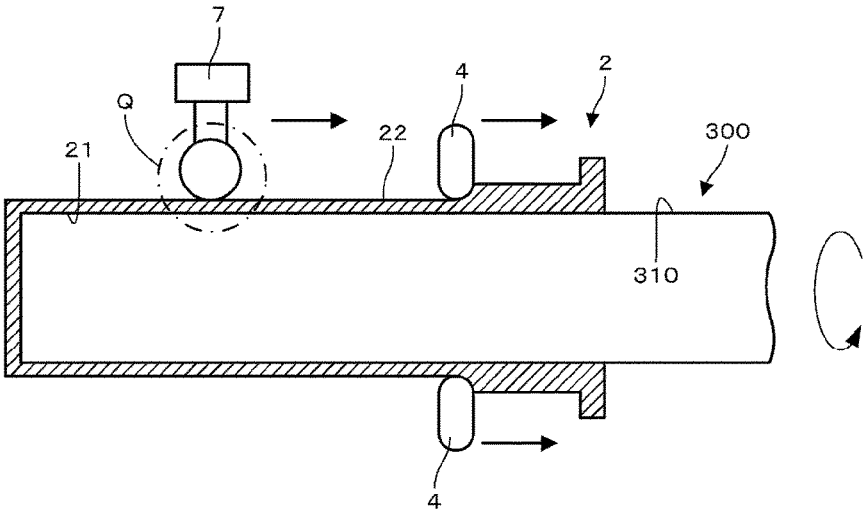
FIGS. 6A and 6B illustrate the method for manufacturing a fixing sleeve according to the second embodiment of the present invention, FIG. 6A being an explanatory drawing illustrating the step of removing the roller marks simultaneously with the spinning process, and FIG. 6B being an enlarged cross-sectional view of the Q portion depicted in FIG. 6A.
Figure 6B:
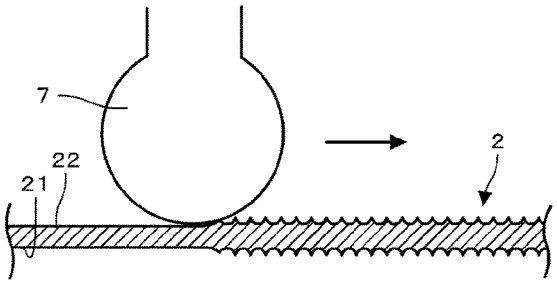

FIGS. 6A and 6B illustrate the method for manufacturing a fixing sleeve according to the second embodiment of the present invention. FIG. 6A is an explanatory drawing illustrating a step of removing the roller marks simultaneously with the spinning process. FIG. 6B is an enlarged cross-sectional view of the Q portion depicted in FIG. 6A. As depicted in FIG. 6A, at the same time as the spinning process is performed by moving the rollers 4 in the axial direction of the cup-shaped tubular body 2, a burnishing tool (spherical tool) 7 is pressed against the outer circumferential surface 22 of the cup-shaped tubular body 2 after the spinning process, and the burnishing tool 7 is moved in the same direction as the movement direction of the rollers 4. The cup-shaped tubular body 2 is plastically deformed in the axial direction of the cup-shaped tubular body 2, reduced in wall thickness, and elongated in the axial direction.

Then, where both ends of the cup-shaped tubular body 2 subjected to the roller mark removal process are cut with the parting bytes 5 in the same manner as depicted in FIG. 2B illustrating the first embodiment, a tubular fixing sleeve 6 is obtained. In the second embodiment, the conventional mandrel is used as the mandrel 300 to be fitted on the inner circumferential surface 21 of the cup-shaped tubular body 2. As depicted in FIG. 6B, the burnishing tool 7 crushes the roller marks created in the spinning process, removes the roller marks, and flattens the surface.

Figure 7:
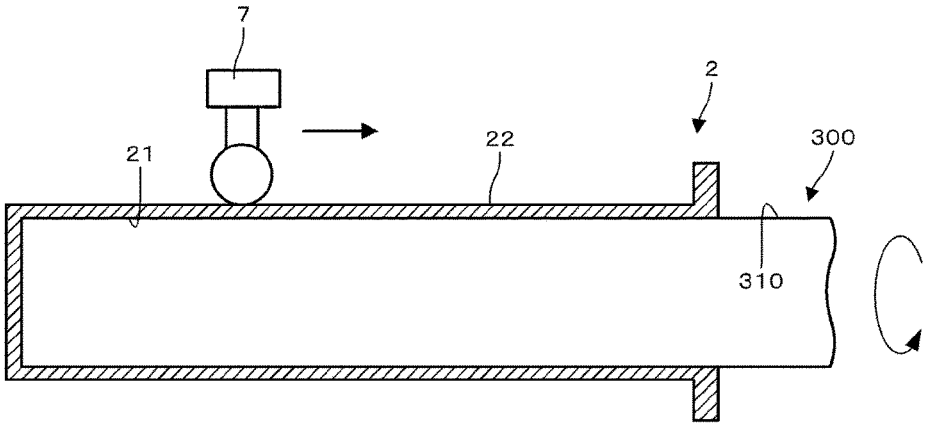
FIG. 7 is an explanatory drawing illustrating a variation example of the method for manufacturing a fixing sleeve according to the second embodiment of the present invention, the drawing depicting a step of removing the roller marks separately from the spinning process.

FIG. 7 is an explanatory drawing illustrating a variation example of the method for manufacturing a fixing sleeve according to the second embodiment of the present invention, the drawing depicting a step of removing the roller marks separately from the spinning process. As depicted in FIG. 7, the burnishing tool (spherical tool) 7 is pressed against the outer circumferential surface 22 of the cup-shaped tubular body 2 which has been reduced in wall thickness and elongated in the axial direction by the spinning process, and the burnishing tool 7 is moved in the axial direction of the cup-shaped tubular body 2 to collapse the roller marks formed during the spinning process. Where both ends of the cup-shaped tubular body 2 subjected to the roller mark removal process are cut with the parting bytes 5 in the same manner as depicted in FIG. 2B illustrating the first embodiment, the tubular fixing sleeve 6 is obtained.

Figure 8A:
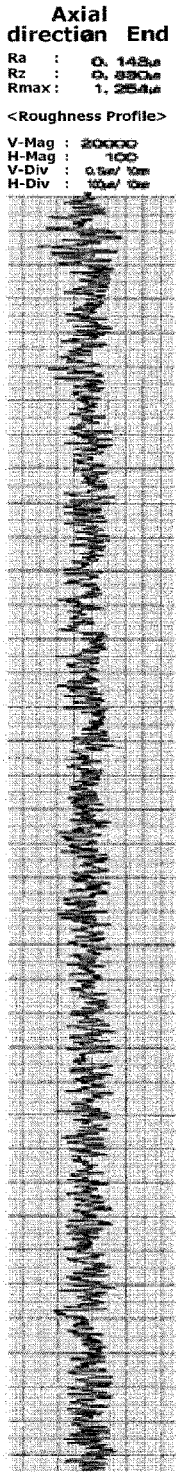
FIGS. 8A-8D illustrate data obtained by measuring the surface roughness of the inner circumferential surface of the fixing sleeve subjected to the roller mark removal process according to the second embodiment of the present invention.
Figure 8B:
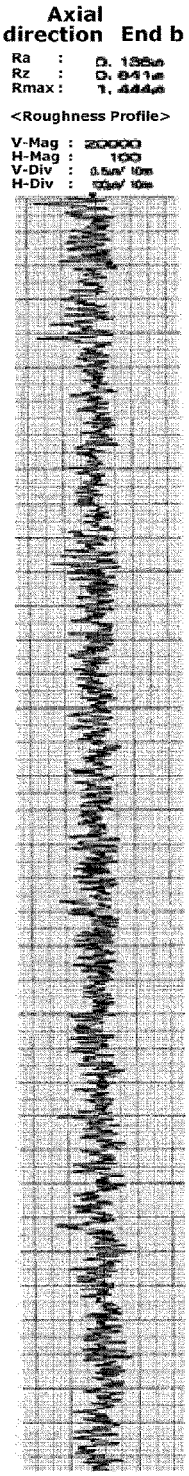
Figure 8C:
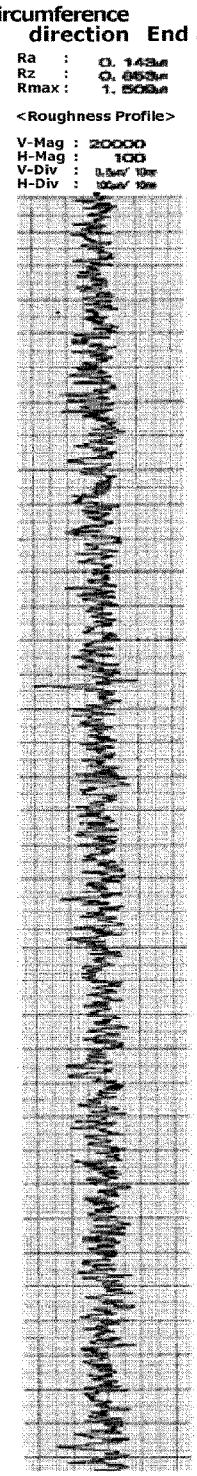
Figure 8D:
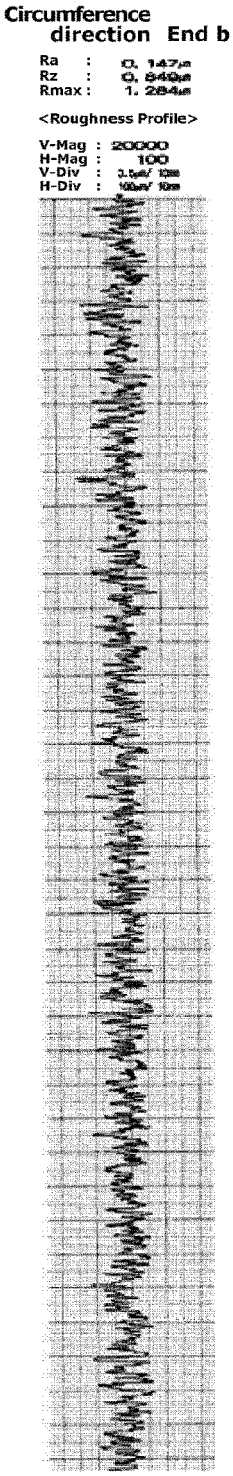

FIGS. 8A-8D illustrate data obtained by measuring the surface roughness of the inner circumferential surface 61 of the fixing sleeve 6 subjected to the roller mark removal process according to the second embodiment of the present invention. Thus, FIG. 8A shows data obtained by measuring the axial surface roughness of the end (a) in FIG. 2B. FIG. 8B shows data obtained by measuring the axial surface roughness of the end (b) in FIG. 2B. FIG. 8C shows data obtained by measuring the circumferential surface roughness of the end (a) in FIG. 2B. FIG. 8D shows data obtained by measuring the circumferential surface roughness of the end (b) in FIG. 2B. As depicted in FIGS. 8A-8D, on the inner circumferential surface 61 of the fixing sleeve 6 subjected to the roller mark removal process according to the second embodiment, the center line average roughness (Ra) is 0.136 μm to 0.147 μm, the ten-point average height (Rz) is 0.830 μm to 0.853 μm, and the maximum height (Rmax) is 1.254 μm to 1.509 μm. Thus, large depressions and protrusions (roller marks) are removed, as compared with the prior art. Further, the center line average roughness (Ra), ten-point average height (Rz), and maximum height (Rmax) are substantially the same, and a large number of fine protrusions and depressions remain. In addition, the center line average roughness (Ra) and ten-point average height (Rz) in the axial direction and circumferential direction are substantially the same. Since a large number of fine protrusions and depressions remain, the lubricating oil can be retained at the inner circumferential surface 61 of the fixing sleeve 6.

FIGS. 9A-9D illustrate data obtained by measuring the surface roughness of the inner circumferential surface of the fixing sleeve when the spinning process with the mandrel according to the first embodiment of the present invention was combined with the roller mark removal process according to the second embodiment. Thus, in the configuration depicted in FIG. 6A, the mandrel 300 was replaced with the mandrel 3 of the first embodiment, the spinning process was performed by moving the rollers 4 in the axial direction of the cup-shaped tubular body 2, at the same time the burnishing tool 7 was pressed against the outer circumferential surface 22 of the cup-shaped tubular body 2 subjected to the spinning process, and the processing was performed by moving the burnishing tool 7 in the same direction as the movement direction of the rollers 4.

Figure 9A:
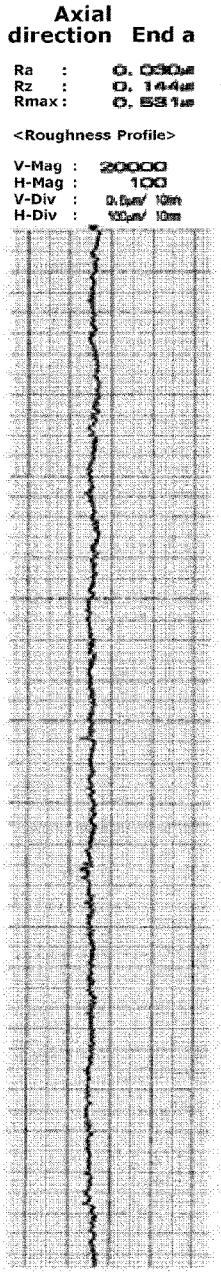
FIGS. 9A-9D illustrate data obtained by measuring the surface roughness of the inner circumferential surface of the fixing sleeve when the spinning process with the mandrel according to the first embodiment of the present invention was combined with the roller mark removal process according to the second embodiment.
Figure 9B:
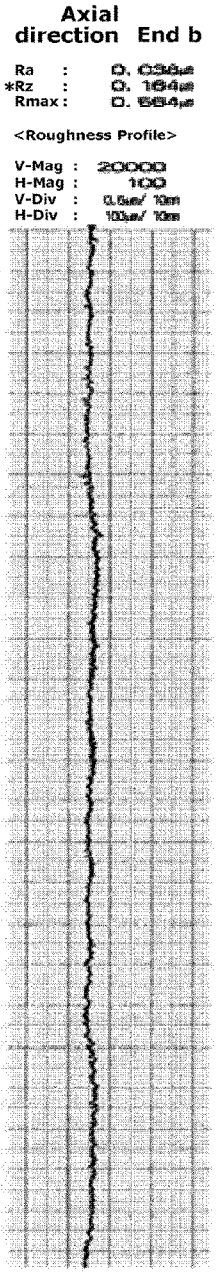
Figure 9C:
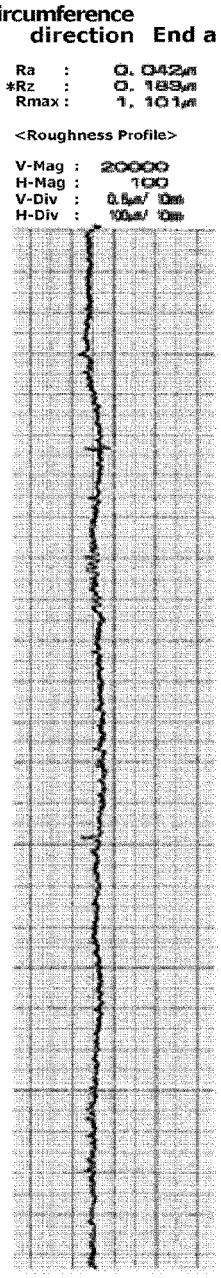
Figure 9D:
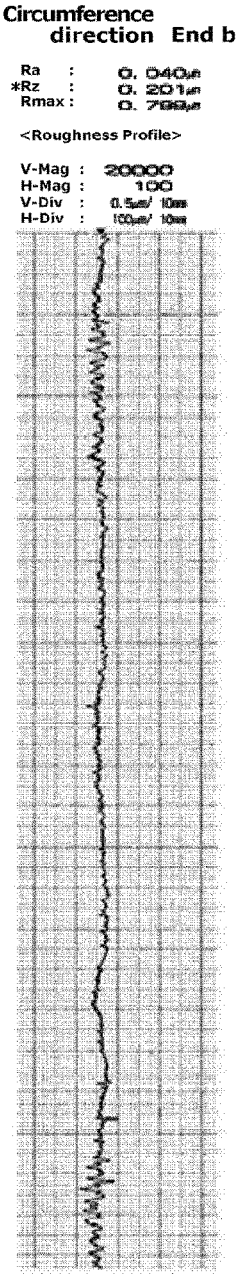

Thus, FIG. 9A shows data obtained by measuring the axial surface roughness of the end (a) in FIG. 2B. FIG. 9B shows data obtained by measuring the axial surface roughness of the end (b) in FIG. 2B. FIG. 9C shows data obtained by measuring the circumferential surface roughness of the end (a) in FIG. 2B. FIG. 9D shows data obtained by measuring the circumferential surface roughness of the end (b) in FIG. 2B. As depicted in FIGS. 9A-9D, on the inner circumferential surface 61 of the fixing sleeve 6 subjected to the spinning process according to the first embodiment in combination with the roller mark removal process, the center line average roughness (Ra) is 0.030 μm to 0.042 μm, the ten-point average height (Rz) is 0.144 μm to 0.201 μm, and the maximum height (Rmax) is 0.531 μm to 1.101 μm. Thus, the center line average roughness (Ra) and ten-point average height (Rz) are about four times less and the maximum height (Rmax) is about two times less than those of the prior art, and fine protrusions and depressions (roller marks) are eliminated.

[Third Embodiment of the Method for Manufacturing a Fixing Sleeve]

Figure 10:
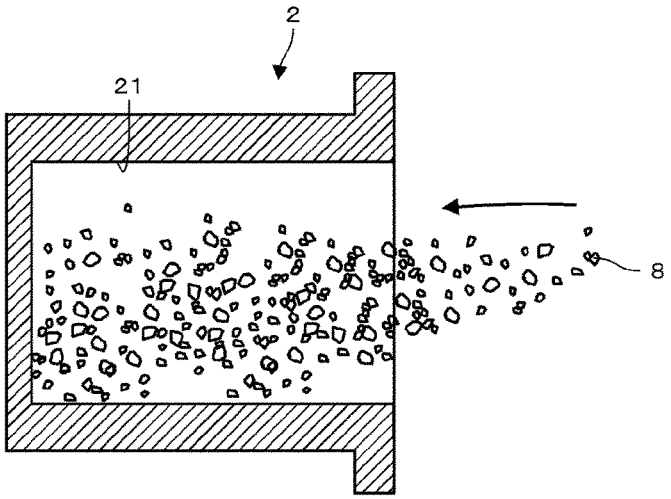
FIG. 10 is an explanatory drawing illustrating the method for manufacturing a fixing sleeve according to the third embodiment of the present invention, the drawing depicting a step of sandblasting the inner circumferential surface of the cup-shaped tubular body molded by deep drawing.

FIG. 10 is an explanatory drawing illustrating the method for manufacturing a fixing sleeve according to the third embodiment of the present invention, the drawing depicting a step of sandblasting the inner circumferential surface of the cup-shaped tubular body molded by deep drawing. As depicted in FIG. 10, particles or abrasive grains 8 of alumina, etc., are blown onto the inner circumferential surface 21 of the cup-shaped tubular body 2, and the inner circumferential surface 21 is uniformly satin finished. Mechanical polishing or chemical polishing may be performed instead of sandblasting. Then, the spinning process is performed with respect to the cup-shaped tubular body 2 subjected to sandblasting. The conventional mandrel was used for fitting on the inner circumferential surface 21 of the cup-shaped tubular body 2.

Figures 11A, 11B:
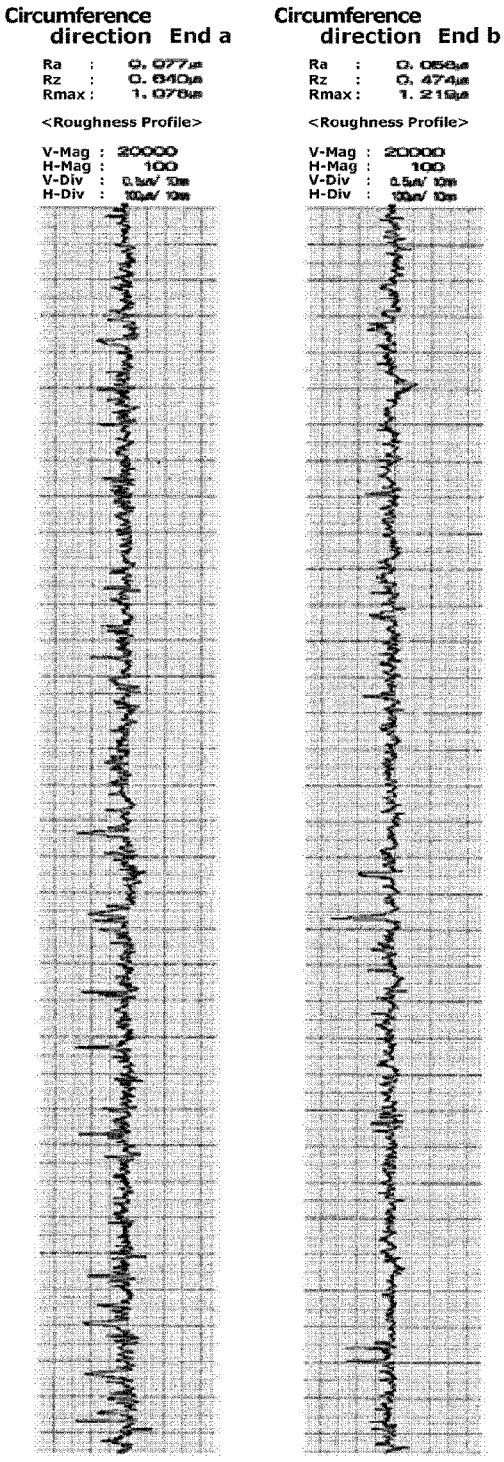
FIGS. 11A and 11B illustrate data obtained by measuring the surface roughness of the inner circumferential surface of the fixing sleeve processed by spinning process with the conventional mandrel after performing the sandblasting according to the third embodiment of the present invention.

FIGS. 11A and 11B illustrate data obtained by measuring the surface roughness of the inner circumferential surface 61 of the fixing sleeve 6 processed by spinning process with the conventional mandrel after performing the sandblasting according to the third embodiment of the present invention. Thus, FIG. 11A shows data obtained by measuring the circumferential surface roughness of the end (a) in FIG. 2B. FIG. 11B shows data obtained by measuring the circumferential surface roughness of the end (b) in FIG. 2B. As depicted in FIGS. 11A and 11B, on the inner circumferential surface 61 of the fixing sleeve 6 processed by spinning process with the conventional mandrel after performing the sandblasting according to the third embodiment, the center line average roughness (Ra) is 0.058 μm to 0.077 μm, the ten-point average height (Rz) is 0.474 μm to 0.640 μm, and the maximum height (Rmax) is 1.078 μm to 1.219 μm.

As compared with the prior art method, large depressions and protrusions (roller marks) are removed, the center line average roughness (Ra) and ten-point average height (Rz) are reduced by a factor of about two, the maximum height (Rmax) is about the same, and a large number of fine protrusions and depressions remain. Since a large number of fine protrusions and depressions remain, the lubricating oil can be retained at the inner circumferential surface 61 of the fixing sleeve 6. Where the sandblasting according to the third embodiment of the present invention is used together with the roller mark removal process according to the second embodiment, large depressions and protrusions (roller marks) can be removed, fine depressions and protrusions remain, and the lubricating oil can be retained at the inner circumferential surface 61 of the fixing sleeve 6.

[Fourth Embodiment of the Method for Manufacturing a Fixing Sleeve]

Figure 12:
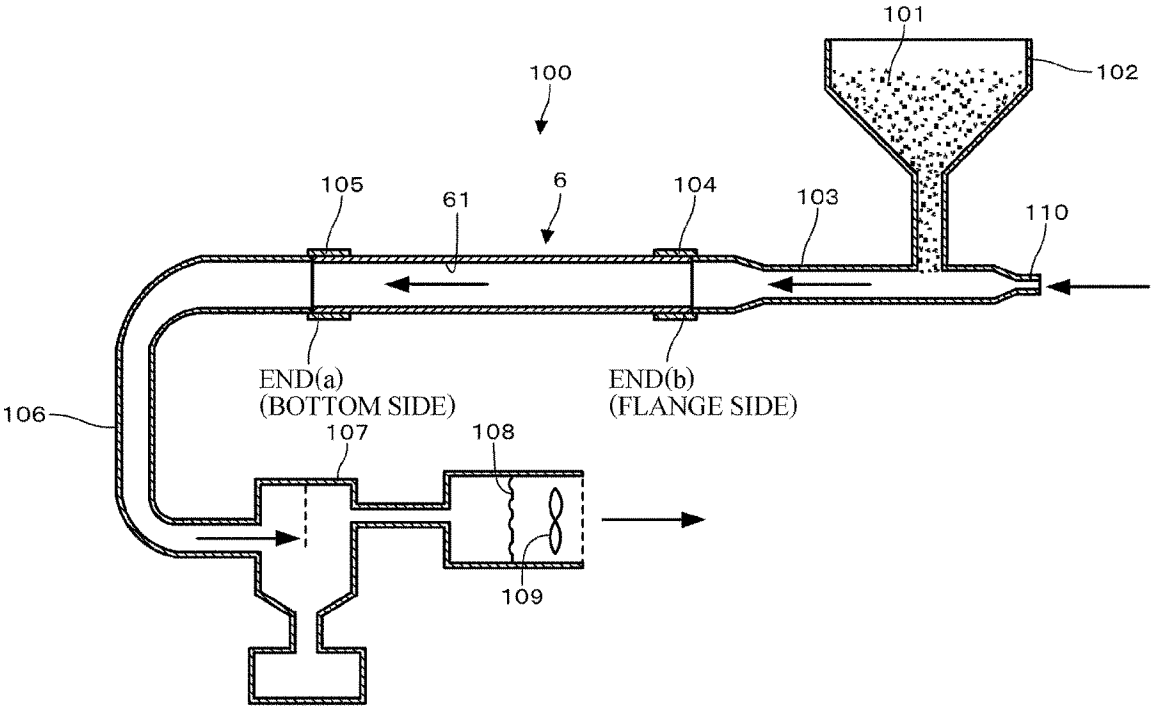
FIG. 12 is an explanatory drawing illustrating the inner surface polishing device of a negative-pressure suction type, this figure illustrating the method for manufacturing a fixing sleeve according to the fourth embodiment of the present invention; the inner surface polishing device polishes the inner circumferential surface of the fixing sleeve processed by spinning process with the conventional mandrel.

FIG. 12 is an explanatory drawing illustrating an inner surface polishing device 100 of a negative-pressure suction type, this figure illustrating the method for manufacturing a fixing sleeve according to the fourth embodiment of the present invention. The inner surface polishing device 100 polishes the inner circumferential surface 61 of the fixing sleeve 6. Thus, the inner circumferential surface 61 of the fixing sleeve 6 is polished after spinning with the conventional mandrel 300 (see FIG. 3A). The fixing sleeve 6 depicted in FIG. 12 is the tubular fixing sleeve 6. The fixing sleeve 6 is molded into the tubular shape by cutting both ends of the cup-shaped tubular body 2 subjected to the spinning process with the parting bytes 5, as depicted in the above-described FIG. 2B. As depicted in FIG. 12, the inner surface polishing device 100 is constituted by a hopper tank 102 storing a polishing material 101, a polishing material conveying pipe 103, fixing sleeve mounting sections 104, 105, an air suction pipe 106, a cyclone separator 107, a filter 108, and a suction blower 109. After the fixing sleeve 6 is connected between the fixing sleeve mounting sections 104, 105, the abrasive material 101 is sucked in by the suction blower 109 in a suitable amount from the hopper tank 102, while falling down therefrom.

An air supply pipe 110 is provided at the suction side (right side in FIG. 12) of the polishing material conveying pipe 103. The polishing material 101 is jetted together with the secondary air sucked in from the air supply pipe 110 into the polishing material conveying pipe 103 and to the inner circumferential surface 61 of the fixing sleeve 6. When the polishing material 101 passes through the inner circumferential surface 61, depressions and protrusions present on the inner circumferential surface 61 of the fixing sleeve 6 are removed and the inner circumferential surface 61 is polished. The removed depressions and protrusions and the polishing material 101 are recovered by the cyclone separator 107. The polishing material 101 is jetted from the end (b) (flange-side end) towards the end (a) (bottom-side end) of the fixing sleeve 6. The secondary air which has passed through the cyclone separator 107 is purified by a filter 108 and released to the outside from the suction blower 109. In the inner surface polishing device 100 of a negative pressure suction type, a negative pressure is uniformly applied over the entire length, in the axial direction, of the inner circumferential surface 61 of the fixing sleeve 6. Therefore, the inner circumferential surface 61 of the fixing sleeve 6 can be uniformly polished from the inlet to the outlet.

Figure 13B:
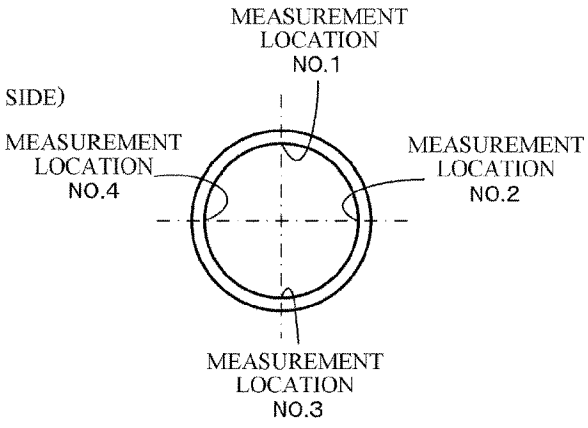
FIGS. 13A and 13B are explanatory drawings illustrating the locations for measuring the surface roughness of the inner circumferential surface of the fixing sleeve polished with the inner surface polishing device depicted in FIG. 12, FIG. 13A being a vertical sectional view of the fixing sleeve, and FIG. 13B being a right-side view of the fixing sleeve depicted in FIG. 13A.
Figure 13A:
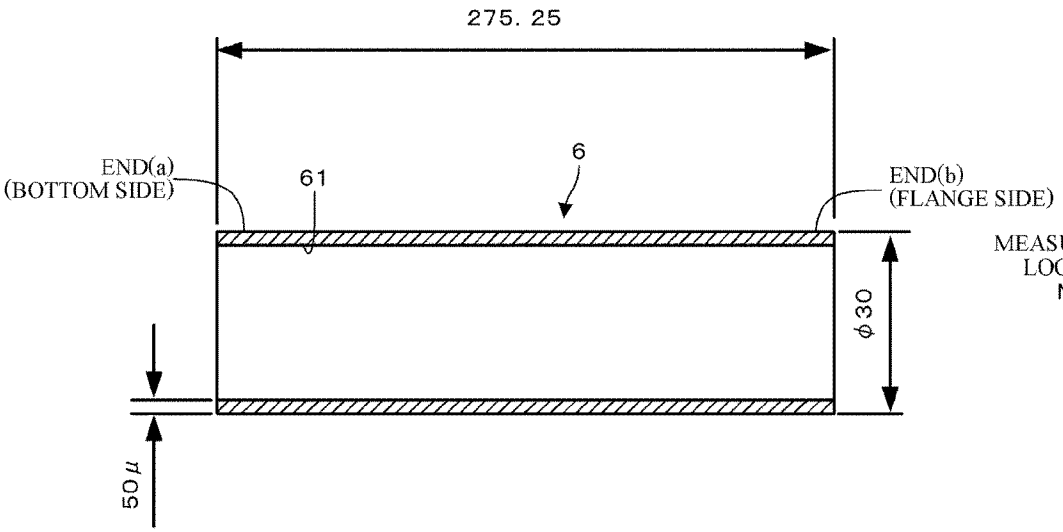
Figure 15:
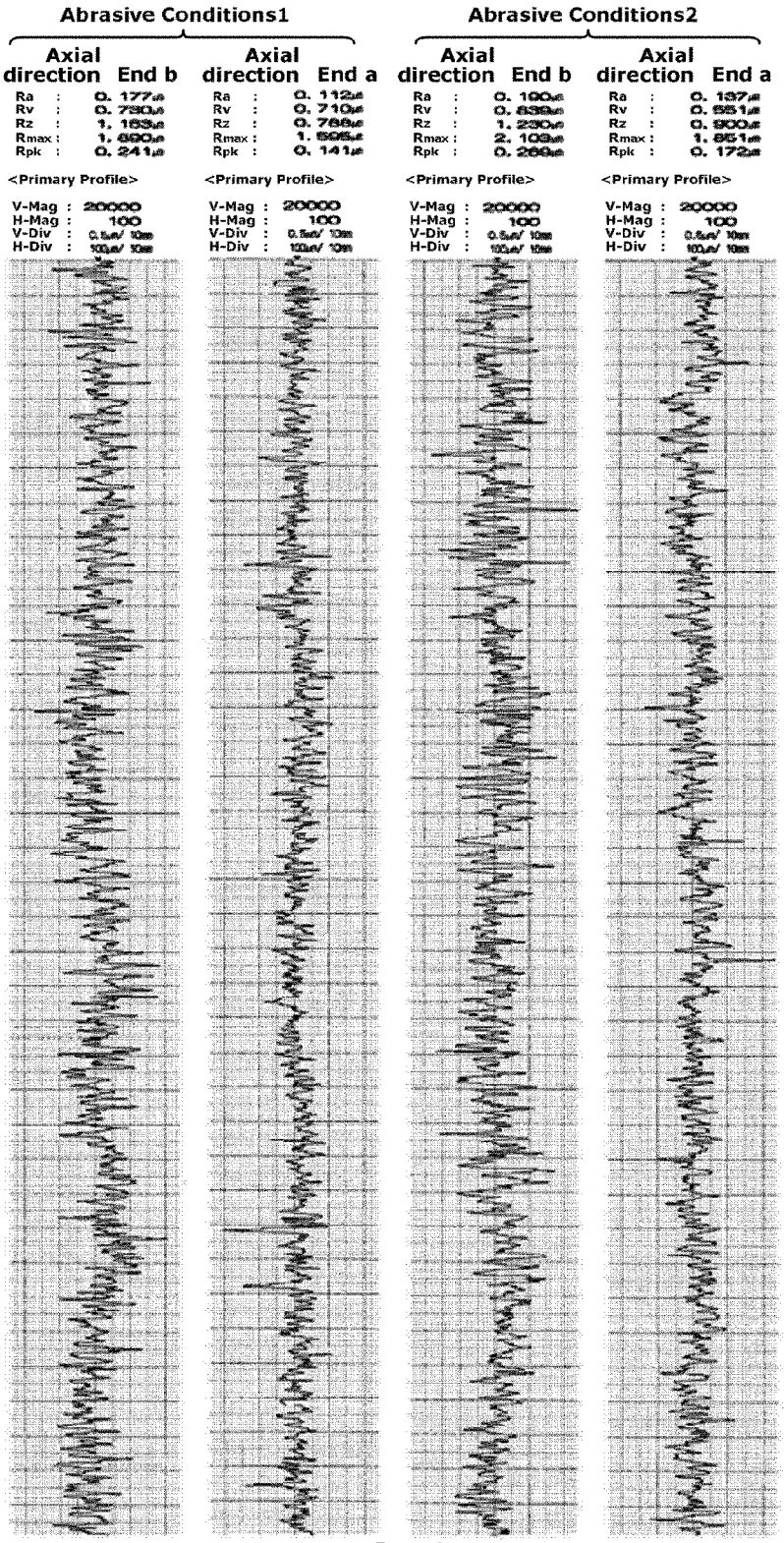
FIG. 15 shows data obtained by measuring the surface roughness under the Abrasive Condition 1 and Abrasive Condition 2 depicted in FIG. 14; those data were obtained by measuring the axial surface roughness at the end portion (b) and end portion (a) of the measurement location NO. 1.

FIGS. 13A and 13B are explanatory drawings illustrating the locations for measuring the surface roughness of the inner circumferential surface 61 of the fixing sleeve 6 polished with the inner surface polishing device 100 depicted in FIG. 12. FIG. 13A is a vertical sectional view of the fixing sleeve 6, and FIG. 13B is a right-side view of the fixing sleeve depicted in FIG. 13A. As depicted in FIGS. 13A and 13B, the inner circumferential surface 61 of the fixing sleeve (diameter 30 mm, wall thickness 50 μm, length in the axial direction 275.25 mm) 6 is divided into four equal 90° segments, and the measurement locations are referred to as NO. 1 to NO. 4 in the clockwise order. The surface roughness at both ends (end (a) on the bottom side and end (b) on the flange side) in the axial direction at each of measurement locations NO. 1 to NO. 4 are measured. The left end in FIG. 13A is end (a) (bottom side) and the right end is end (b) (flange side). Thus, the surface roughness was measured in a total of (measurement locations NO. 1 to NO. 4)×(end (a)+end (b))=8 locations for one fixing sleeve 6.

FIG. 14 is a table obtained by measuring the surface roughness, in the axial direction, of the inner circumferential surface 61 of the fixing sleeve 6 subjected to the inner surface polishing. Thus, the surface roughness in (measurement locations NO. 1 to NO. 4)×(2 locations: end (a)+end (b)) was measured for each single fixing sleeve 6 under eight Abrasive Conditions 1 to 8. The average value is the average of the values obtained for the measurement locations NO. 1 to NO. 4. Four types of surface roughness, namely, the maximum valley depth (Rv), initial wear height (Rpk), center line average roughness (Ra), and ten-point average roughness (Rz) are shown in FIG. 14. As for the Abrasive Conditions 1 to 8, the measurements were performed by changing the combination of negative pressure [−KPa] representing the suction power of the suction blower 109, inner surface polishing time [S], and polishing material. Two types, 45 KPa and 50 KPa, of the negative pressure [−KPa] were used. Two types, 25S and 50S, of the inner surface polishing time (sec [S]) were used. Two types, zircon #320 and SUS #300, of the polishing material were used.

In the method for manufacturing a fixing sleeve according to the fourth embodiment of the present invention, the numerical values of two types, namely, the maximum valley depth (Rv) and initial wear height (Rpk), are used to evaluate the abrasive conditions ensuring the adequate value of the surface roughness of the inner circumferential surface 61 of the fixing sleeve 6. The maximum valley roughness is a numerical value representing the maximum value of the valley depth (Zv) at the contour curve in a reference length. The initial wear height (Rpk) is a numerical value determined from the intersection point of the ordinate and the extension line of the flat section of the load curve, and this numerical value serves to determine the point of change from the point contact to surface contact when the load length ratio (tp) gradually increases due to wear.

The load length ratio (tp) is represented by a percentage of the reference length and the sum of the cutting lengths (load lengths) obtained when the roughness curve extracted based on the reference length is cut at a cutting level parallel to the peak. The load curve is a graph in which the load length ratio (tp) is plotted against the abscissa, and the direction of the height (cutting height) of the roughness curve is plotted against the ordinate. The values of the load length ratio (tp) at each cutting level are plotted. Thus, in order to reduce the wear amount of the surface which is in contact with the heater, it is preferred that the numerical value of the initial wear height (Rpk) of the inner circumferential surface 61 of the fixing sleeve 6 be small. Further, in order to increase the grease retention capacity of the surface that is in contact with the heater, it is preferred that the numerical value of the maximum valley depth (Rv) of the inner circumferential surface 61 of the fixing sleeve 6 be large.

Figure 19:
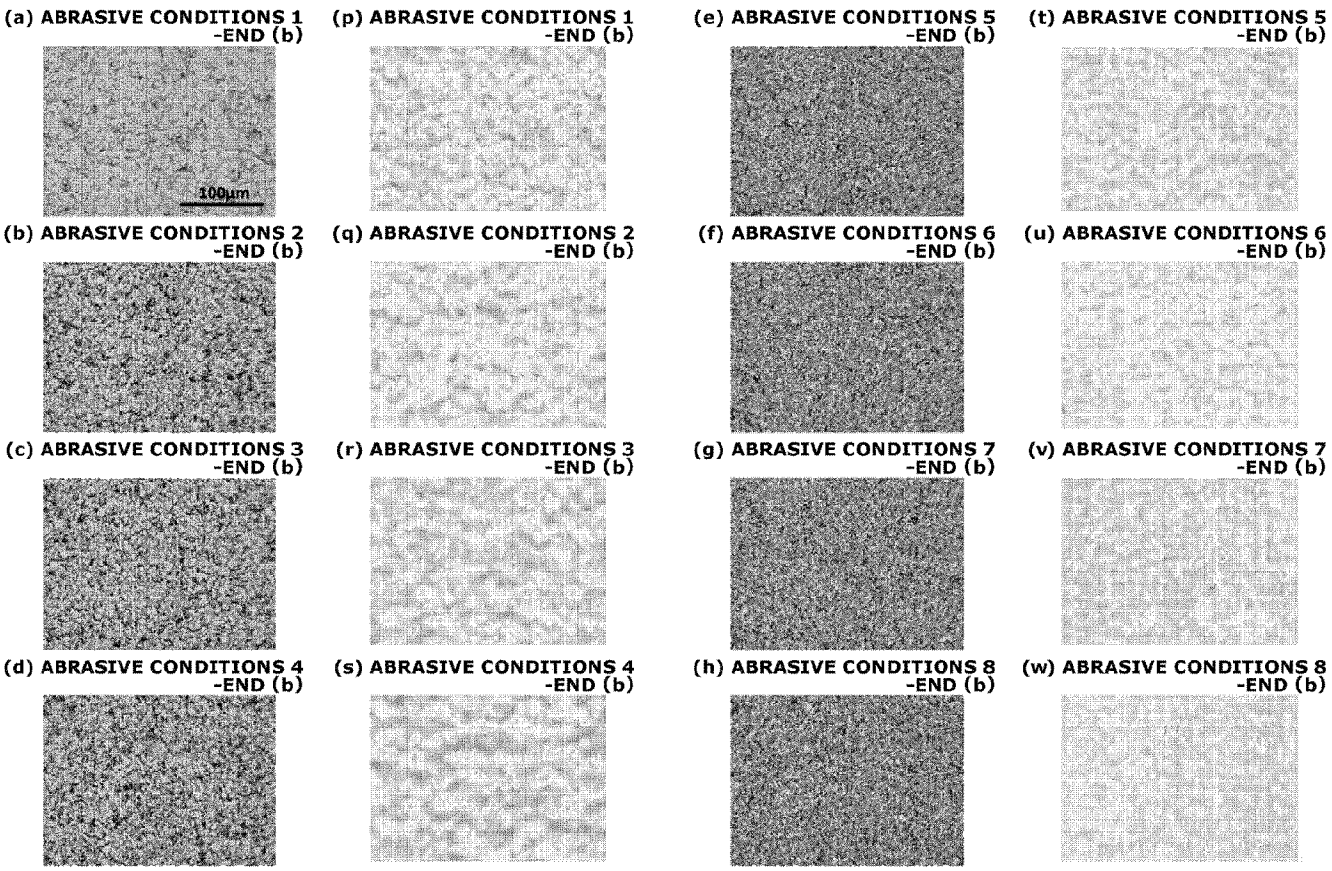
FIG. 19 is a microphotograph of the metal surface polished under the Abrasive Condition 1 to Abrasive Condition 8 depicted in FIG. 14, and FIG. 19 (*a*) to FIG. 19 (*h*) are eight microphotographs (the original color is violet) are the usual microphotographs presented for reference.

FIG. 19 is a microphotograph of the metal surface obtained by polishing the end (b) under the Abrasive Condition 1 to Abrasive Condition 8 depicted in FIG. 14. Here, FIG. 19 (*a*) to FIG. 19 (*h*) are eight microphotographs (the original color is violet) are the usual microphotographs presented for reference. FIG. 19 (*p*) to FIG. 19 (*w*) are eight microphotographs (the original color is yellow) illustrate the height (depth) of protrusions and depressions of the contour curve, light gray portions represent low portions, and dark gray portions represent high portions. FIG. 20A is a table in which the Abrasive Conditions 1 to 8 shown in the table in FIG. 14 are arranged in the order of increasing value Rv, and FIG. 20B is a table in which the Abrasive Conditions 1 to 8 shown in the table in FIG. 14 are arranged in the order of decreasing value of the initial wear height (Rpk).

As depicted in FIG. 20B, where both the average value for the end (b) and the average value for the end (a) are considered, the abrasive condition at which the numerical value of the initial wear height (Rpk) is the smallest is Abrasive Condition 8. Further, as depicted in FIG. 20A, where both the average value for the end (b) and the average value for the end (a) are considered, the abrasive conditions at which the numerical value of the maximum valley depth (Rv) is the largest are the Abrasive Condition 4 and Abrasive Condition 6. Further, under the Abrasive Condition 8, the numerical value of the maximum valley depth (Rv) at the end (b) is the third largest and the numerical value of the maximum valley depth (Rv) at the end (a) is the second largest. As a result, the Abrasive Condition 8 can be evaluated as the abrasive condition at which the numerical value of the initial wear height (Rpk) is small and the numerical value of the maximum valley depth (Rv) is large. By viewing the microphotographs in FIG. 19, it is possible to compare the yellow microphotograph obtained under the Abrasive Condition 8 at which the numerical value of the initial wear height (Rpk) is small with the yellow microphotograph obtained under the Abrasive Condition 4 at which the numerical value of the initial wear height (Rpk) is large. As a result, it can be found that in the yellow (the original color) microphotograph obtained under the Abrasive Condition 8, the surface area of the green (in the original color yellow) low portions and red (in the original color yellow) height portions is less than that of the respective portions in the yellow (the original color) microphotograph obtained under the Abrasive Condition 4.

Figure 16:
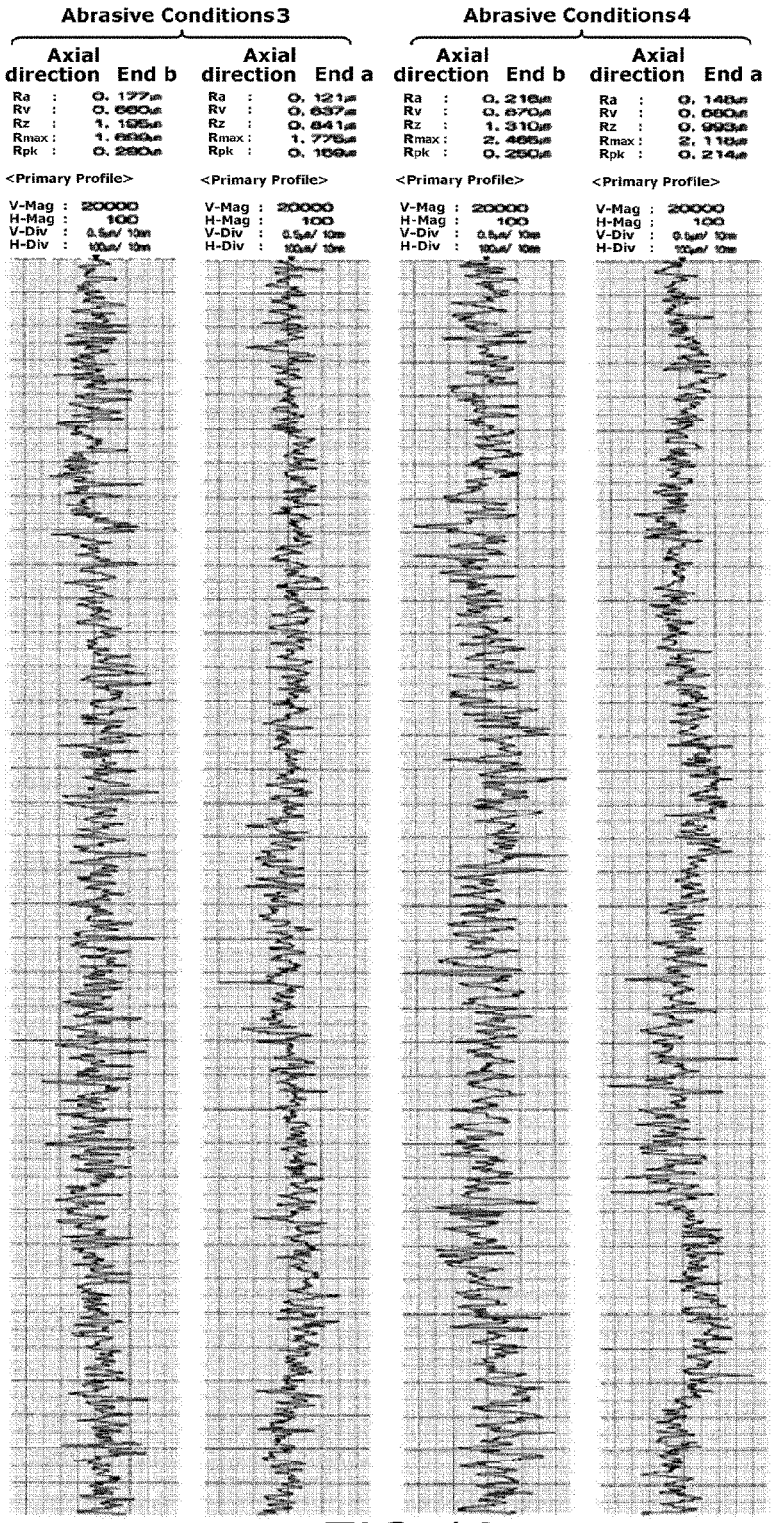
FIG. 16 shows data obtained by measuring the surface roughness under the Abrasive Condition 3 and Abrasive Condition 4 depicted in FIG. 14; those data were obtained by measuring the axial surface roughness at the end portion (b) and end portion (a) of the measurement location NO. 1.
Figure 17:
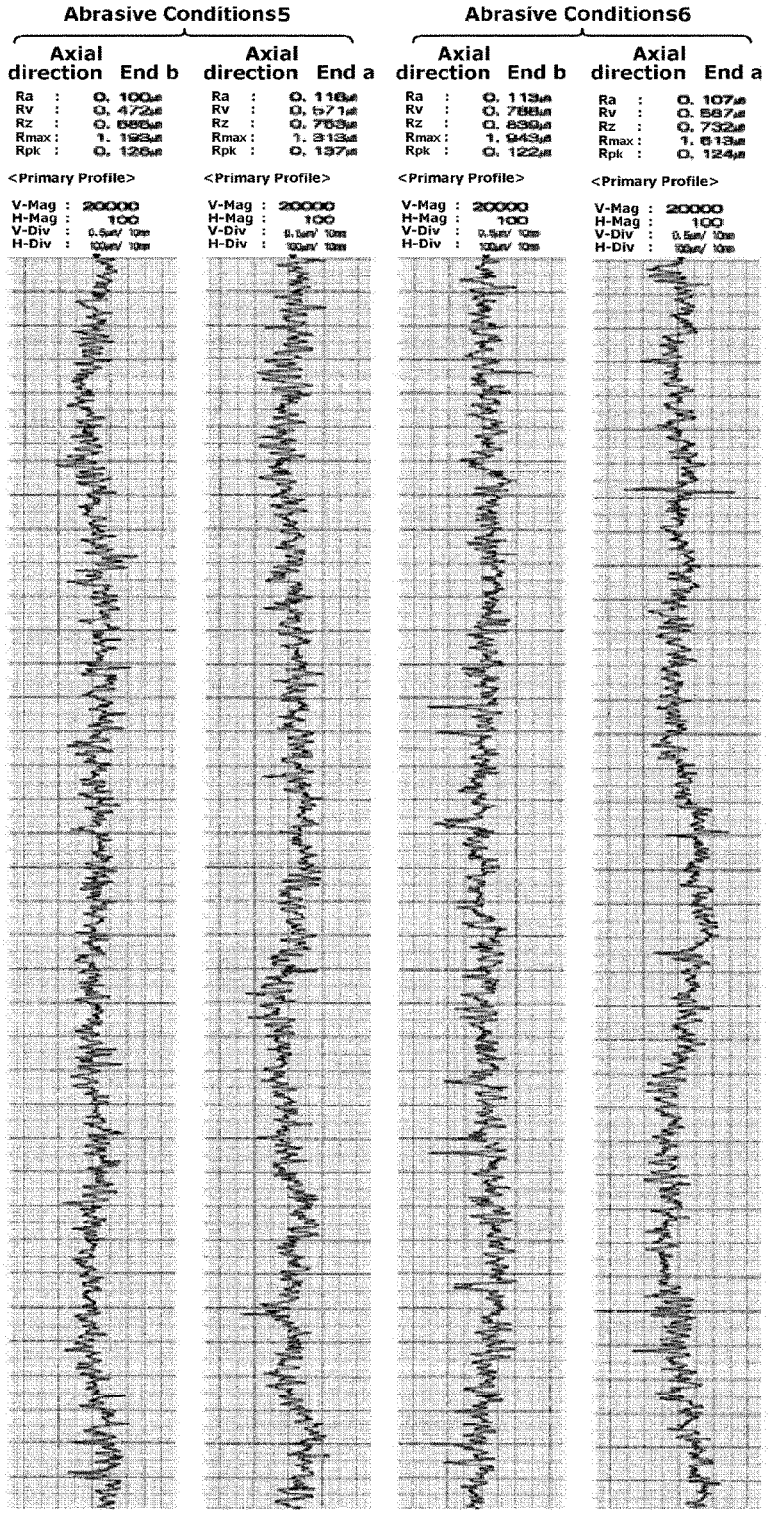
FIG. 17 shows data obtained by measuring the surface roughness under the Abrasive Condition 5 and Abrasive Condition 6 depicted in FIG. 14; those data were obtained by measuring the axial surface roughness at the end portion (b) and end portion (a) of the measurement location NO. 1.
Figure 18:
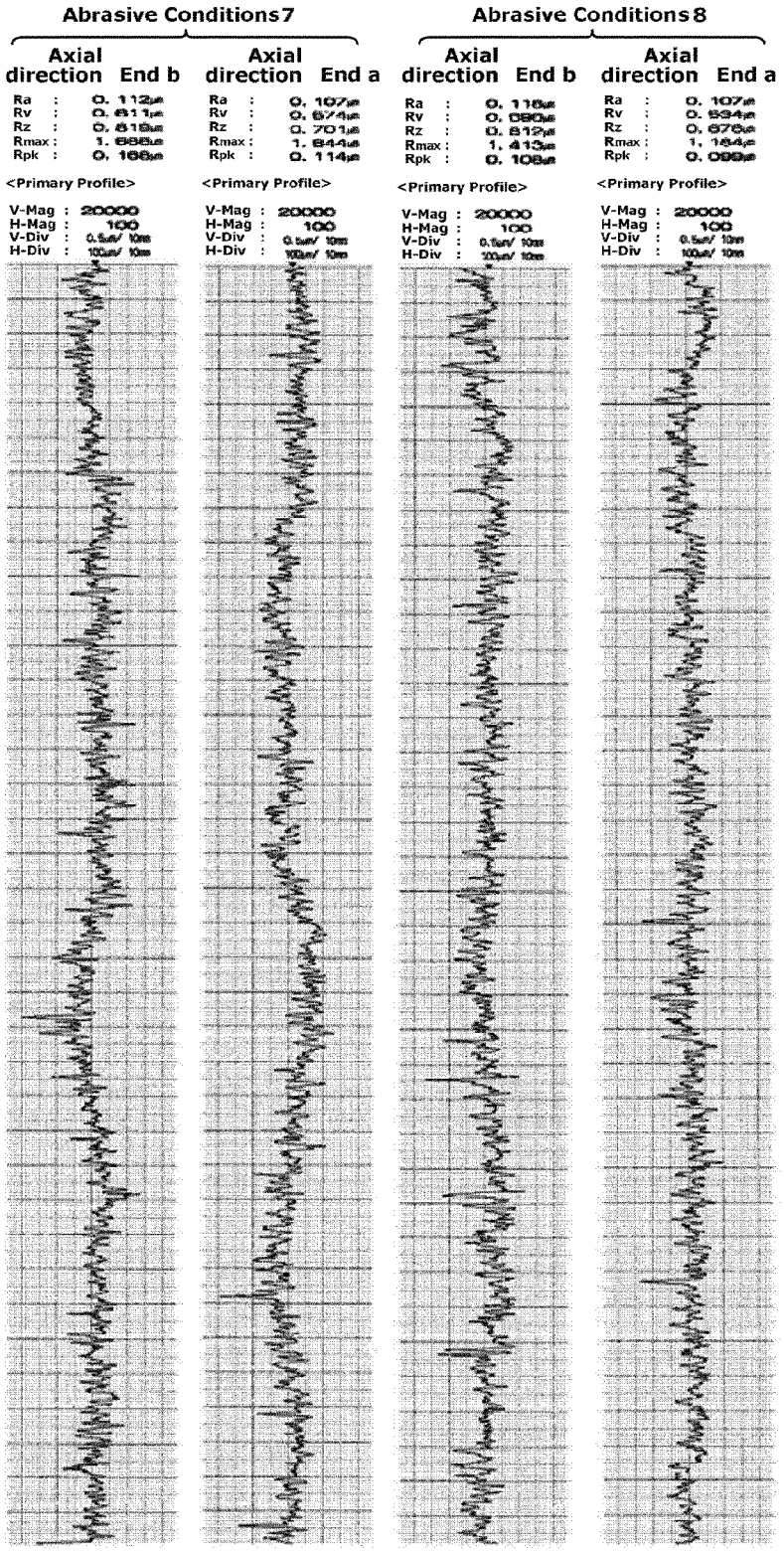
FIG. 18 shows data obtained by measuring the surface roughness under the Abrasive Condition 7 and Abrasive Condition 8 depicted in FIG. 14; those data were obtained by measuring the axial surface roughness at the end portion (b) and end portion (a) of the measurement location NO. 1.

FIGS. 15 to 18 show data obtained by measuring the surface roughness under the Abrasive Conditions 1 to 8. Thus, data obtained under the Abrasive Condition 8 at which the numerical value of the initial wear height (Rpk) is small are compared with data obtained under the Abrasive Condition 4 at which the numerical value of the initial wear height (Rpk) is large. As a result, it can be found that the depressions and protrusions at the contour curve obtained under the Abrasive Condition 8 which are shown in FIG. 18 are clearly less than those at the contour curve obtained under the Abrasive Condition 4 which are shown in FIG. 16.

[Other embodiments]

Embodiments of the present invention are described hereinabove, but the present invention is not limited to those embodiments. For example, the processing may be performed by combining a plurality of manufacturing methods according to any of the above-described first to fourth embodiments.

What is claimed is:

1. A method for manufacturing a fixing sleeve, comprising:

performing a spinning process by fitting a mandrel on an inner circumferential surface of a cup-shaped tubular body which is made of metal and pressing a roller against an outer circumferential surface of the cup-shaped tubular body, thereby elongating the cup-shaped tubular body in an axial direction and reducing a wall thickness of the cup-shaped tubular body, cutting out both ends of the cup-shaped tubular body after the spinning process to form a fixing sleeve of a tubular shape, and performing a polishing process on the inner circumferential surface of the fixing sleeve;

wherein the polishing process further comprises:

holding both ends of the fixing sleeve of the tubular shape by fixing sleeve mounting sections respectively, connecting one end of the fixing sleeve to a polishing material conveying pipe into which an abrasive material is supplied and another end of the fixing sleeve to an air suction pipe, and performing a suction from a side of the air suction pipe so as to causes the abrasive material to be jetted along with an air from a side of the polishing material conveying pipe and to flow through the inner circumferential surface of the fixing sleeve over an entire axial length of the fixing sleeve, due to which an entire inner circumferential surface of the fixing sleeve is uniformly polished to obtain a smooth surface, wherein a roller mark formed during the spinning process is removed by pressing a burnishing tool against the outer circumferential surface of the cup-shaped tubular body at a same time as pressing the roller against the outer circumferential surface of the cup-shaped tubular body, and wherein the burnishing tool moves in the axial direction of the cup-shaped tubular body.

2. The method for manufacturing a fixing sleeve according to claim 1, wherein a surface roughness of the inner circumferential surface of the fixing sleeve is evaluated by two numerical values, namely, a maximum valley depth and an initial wear height.

* * * * *